US007267195B2

(12) United States Patent
Carlier et al.

(10) Patent No.: US 7,267,195 B2
(45) Date of Patent: Sep. 11, 2007

(54) EXHAUST DEVICE WITH OR WITHOUT DILUTION BASED ON TWO CONTROLLABLE OUTPUTS

(75) Inventors: Sylvain Carlier, Guyancourt (FR); Michel Brun, Maintenon (FR); Bernard Timmer, Conflans Sainte Honorine (FR)

(73) Assignee: GIAT Industries, Versailles (FR)

( * ) Notice: Subject to any disclaimer, the term of this patent is extended or adjusted under 35 U.S.C. 154(b) by 378 days.

(21) Appl. No.: 10/512,871

(22) PCT Filed: Apr. 29, 2003

(86) PCT No.: PCT/FR03/01336

§ 371 (c)(1),
(2), (4) Date: Oct. 29, 2004

(87) PCT Pub. No.: WO03/093755

PCT Pub. Date: Nov. 13, 2003

(65) Prior Publication Data

US 2005/0211495 A1 Sep. 29, 2005

(30) Foreign Application Priority Data

May 3, 2002 (FR) ..... 02 05541

(51) Int. Cl.
*F01N 7/00* (2006.01)

(52) U.S. Cl. ..... 180/309; 60/324

(58) Field of Classification Search ..... 180/309, 180/296; 60/324, 288, 323
See application file for complete search history.

(56) References Cited

U.S. PATENT DOCUMENTS

| | | | | |
|---|---|---|---|---|
| 1,339,284 | A | 5/1920 | Petry | |
| 5,323,609 | A * | 6/1994 | Konrath et al. | 60/324 |
| 6,286,307 | B1 * | 9/2001 | Feeny et al. | 60/324 |
| 6,584,767 | B1 * | 7/2003 | Koenig | 60/288 |
| 6,892,531 | B2 * | 5/2005 | Rim | 60/295 |
| 2002/0035920 | A1 * | 3/2002 | Everingham et al. | 95/11 |
| 2004/0194454 | A1 * | 10/2004 | Rim | 60/297 |

FOREIGN PATENT DOCUMENTS

| | | |
|---|---|---|
| DE | 1 086 085 B | 7/1960 |
| FR | 2 776 705 A | 10/1999 |

* cited by examiner

*Primary Examiner*—J. Allen Shriver
(74) *Attorney, Agent, or Firm*—Steptoe & Johnson LLP

(57) ABSTRACT

An exhaust gas distribution device for the engine of a vehicle, wherein said device incorporates means to control the evacuation of the gases towards a classical exhaust system or else towards a specific exhaust system, said specific exhaust system incorporating means to dilute and reduce the visible, sound and infrared signatures of said vehicle.

6 Claims, 1 Drawing Sheet

EXHAUST DEVICE WITH OR WITHOUT DILUTION BASED ON TWO CONTROLLABLE OUTPUTS

BACKGROUND OF THE INVENTION

1. Field of the Invention

The technical scope of the present invention is that of devices intended to reduce the visible and infrared signatures of vehicles, in particular combat vehicles, with respect to their exhaust gases.

2. Description of the Related Art

Up to now, studies attempting to reduce the infrared signature of armoured vehicles have mainly concentrated on the reduction in radiation of the armoured structure by associating techniques to reduce the temperature of the skin and stealthy materials. It now seems that for a stealthy armoured vehicle, the plume of its exhaust gases is a major element in its detectability. Moreover, the evolution of thermal camera technologies allows hot sources to be detected in the land environment at very large distances. To improve the stealth of these vehicles with respect to the evolution of infrared sensors, it is thus now necessary for the energy level radiated by the exhausts of armoured vehicles to be reduced.

Patent FR-2 776 705 proposes an efficient device to uniformly dilute the gases of a military vehicle.

This device has drawbacks, however. Indeed, when the device operates constantly, the drawbacks generated by the device are also constant: when the tank is immersed in water there is the risk of water entering the exhaust circuit, and thus of the engine stalling, and the substantial increase in temperature of the cooling elements. If this device is very useful during operations where the vehicle's stealth is all important, it becomes a hindrance, for example, during maintenance operations where the operators risk getting burned or when fording where it is necessary to mount snorkels.

SUMMARY OF THE INVENTION

The aim of the invention is precisely to improve a vehicle's stealth, a military vehicle for example, and in particular a battle tank, by masking the emission zone of the exhaust gases.

The present invention thus relates to an exhaust gas distribution device for the engine of a vehicle, wherein it incorporates means to control the evacuation of the gases towards a classical exhaust system or else towards a specific exhaust system enabling the visible, sound and infrared signatures to be reduced.

Advantageously, the classical exhaust is configured so as to allow additional outlet interfaces to be added, such as a snorkel, deflection elbow or evacuation sheath.

Advantageously again, the specific exhaust system incorporates means to reduce the infrared, sound and/or visible signature of the exhaust gases.

Advantageously again, the device comprises a valve controlled by the vehicle crew to orient the distribution of the exhaust gases to one or other of the classical or specific systems.

One advantage of the present invention lies in the fact that it is simple to manufacture and may be easily inserted into a vehicle.

According to one embodiment, the signature reduction exhaust has an obturating system using plates allowing it to be insulated from the exterior, namely during the immersion of the vehicle.

BRIEF DESCRIPTION OF THE DRAWINGS

Other characteristics, particulars and advantages of the invention will become more apparent from the description given hereafter by way of illustration and in reference to the drawings, in which.

DETAILED DESCRIPTION OF PREFERRED EMBODIMENTS

Figure 1:
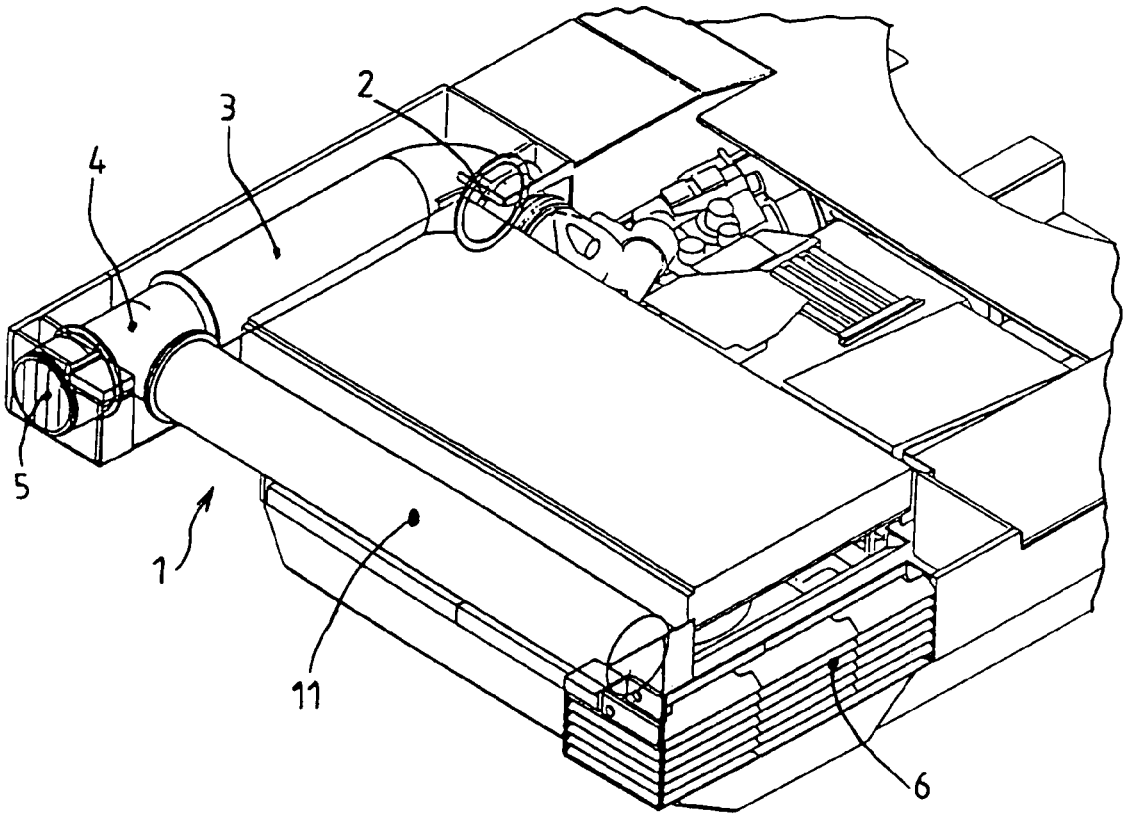
FIG. 1 shows an exhaust system according to the invention.

FIG. 1 shows an exhaust device 1 with two controllable outlets which, according to the invention, is composed of an inlet mouth 2 directly linked to the outlet of the engine's turbocompressor, attached to a pipe 3 opening into a distributor 4 and two exhausts, classical 5 and specific 6. Exhaust 5 is a classical exhaust opening out directly to the exterior. It has no heat dilution device and interfaces such as a snorkel (for example during fording), a deflection elbows or an evacuation sheath (for example to evacuate the gases during workshop maintenance operations) may be adapted onto it. Pipe 11 guides the exhaust gases towards the specific exhaust 6. This exhaust 6 is an exhaust that reduces and dilutes visible, sound and infrared emissions. Such an exhaust is already known and its operating principle does not require further description. However, different types of reduction and dilution exhausts may be envisaged for the visible, sound and infrared emissions. Reference may be made namely to patent FR 98-03720 that describes a pipe equipped, along a longitudinal band, with calibrated perforations ensuring a uniform flow of gas to the exterior from up to downstream. Another embodiment of this exhaust consists in mixing up the exhaust gases with air at a lower temperature and then evacuating the cooled mixture to the exterior. These embodiments are naturally given by way of example and others may be envisaged.

This specific exhaust also gives the possibility of locating the exhaust outlet at the rear or to the side of a vehicle.

In the case of an embodiment of the dilution device such as that described by patent FR 98-03720, the slots in the dilution pipe are made so as to orient the gases in a horizontal direction or downwards without them coming directly into contact with the ground. Generally speaking, the device is designed to prevent the exhaust gases from being oriented directly to the ground in order to prevent the ground from heating up and avoid the creation of a cloud of dust that would adversely affect the infrared and visible stealth of the vehicle.

The provision of an obturating system using plates on the exhaust 6 is also foreseen allowing it to be insulated from the exterior, namely when the vehicle is to be immersed.

Figure 2A:
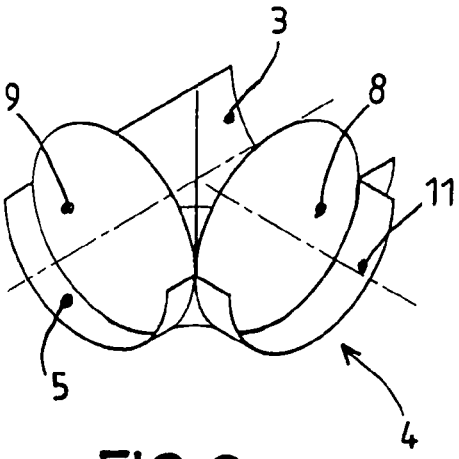
FIGS. 2*a* and 2*b* show the distribution system, on a different scale, which enables the switch to be made from one exhaust system to the other.
Figure 2B:
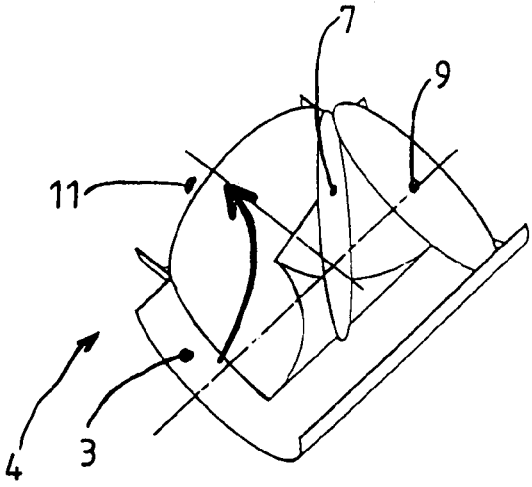

FIGS. 2*a* and 2*b* illustrate the structure and functioning of the distributor 4. This distributor is placed between the pipe 3 and the classical exhaust 5 of the exhaust gases and incorporates orientation means 7, a valve for example, enabling the exhaust gases to be sent towards exhaust 5 or towards the pipe 11. These means 7 are controlled by an electric motor, a magnetic control or any other manual or motorised system (not shown) enabling its orientation so that it can take up either position 8 or position 9. When the valve is in position 8, the path to the specific exhaust 6 is closed off and the gases circulate towards the classical exhaust 5. If the valve is moved into position 9, the path towards the classical exhaust 5 is closed and the gases are directed towards pipe 11 of the specific exhaust 6. The exhaust gases are then adequately diluted so as to improve the vehicle's stealth.

The device according to the invention may be applied to any type of vehicle required to be made stealthy to whose stealth is sought to be improved. This is the case, for example, of military vehicles, in particular troop transport vehicles or combat vehicles such as armoured vehicles.

The invention claimed is:

1. An exhaust gas distribution device for the engine of a vehicle, comprising:

a classical exhaust system for exiting exhaust gas directly to the exterior environment;

a specific exhaust system comprising means for diluting and reducing visible, sound and infrared signatures of exhaust gases before exiting to the exterior environment; and means for selectively controlling flow of exhaust gases from an engine towards one of the classical exhaust system or the specific exhaust system, wherein the specific exhaust system is located for exiting exhaust gas from a side or a rear of a vehicle on which the device is mounted.

2. An exhaust gas distribution device for the engine of a vehicle according to claim 1, wherein the classical exhaust system further comprises means for attaching additional outlet interfaces selected from the group consisting of a snorkel, a deflection elbow and an evacuation sheath.

3. An exhaust gas distribution device for the engine of a vehicle according to claim 1, where the means for controlling flow comprises a manually controllable valve to direct the distribution of exhaust gases to either of the classical or specific systems.

4. An exhaust gas distribution device for the engine of a military vehicle according to claim 1, wherein the specific exhaust system comprises an obturating system comprising plates for insulating said obturating system from the exterior environment.

5. An exhaust gas distribution device for the engine of a vehicle according to claim 1, where the means for controlling flow comprises a manually controllable valve to direct the distribution of exhaust gases to either of the classical or specific systems.

6. An exhaust gas distribution device for the engine of a military vehicle according to claim 1, wherein the specific exhaust system comprises an obturating system comprising plates for insulating said obturating system from the exterior environment.

* * * * *